US005439202A

United States Patent [19]

Scriven

[11] Patent Number: 5,439,202

[45] Date of Patent: Aug. 8, 1995

[54] APPARATUS FOR REMOVING A COVER FROM A HOT METAL TRANSFER CAR

[76] Inventor: Ricky R. Scriven, 11331 Old Goddard Apt., Allen Park, Mich. 48101

[21] Appl. No.: 114,151

[22] Filed: Sep. 1, 1993

[51] Int. Cl.[6] ..... C21B 3/10

[52] U.S. Cl. ..... 266/165; 266/236; 266/271

[58] Field of Search ..... 266/165, 236, 271, 272, 266/276, 248

[56] References Cited

U.S. PATENT DOCUMENTS 1,661,745 3/1928 Brosius ..... 266/272
4,298,191 11/1981 Atkinson et al. ..... 266/165
4,381,855 5/1983 Ryan ..... 266/248
4,390,170 6/1983 Schaefer, IV et al. ..... 266/165
5,022,635 6/1991 Scriven ..... 266/165

*Primary Examiner*—Scott Kastler
*Attorney, Agent, or Firm*—Weintraub, DuRoss & Brady

[57] ABSTRACT

An apparatus for removing a cover from a transport car is mounted to the car and has a swing member connected to the cover of the car. The swing member is pulled away, with the cover, by rolling down a pair of guide members to a termination point. A winch is used to pull the swing member back into position to block the opening of the transport car with the cover. The apparatus allows manual removal or placement of the cover on the transport car in environments where the space over the car is restricted.

11 Claims, 2 Drawing Sheets

10
12
14
15
18
22
24
26
28
30
32
34
36
38
42a
44a
46a
48
50
52
54
54a
56a
60
61a
64
66
68
69
70
72
74
A
B
C

APPARATUS FOR REMOVING A COVER FROM A HOT METAL TRANSFER CAR

BACKGROUND OF THE INVENTION

1. Field of Invention

The present invention relates to covers for molten metal cars, More particularly, the present invention concerns an apparatus for removing and installing a cover from a transfer car having liquid metal contained therein.

2. Description of Prior Art

Transfer cars to move molten metals between processing stations in a steel mill or foundry are well known. One problem related with this transportation system is the heat lost by the molten metal during transportation. If the liquidized metal cools below certain points, the metal may, at a minimum, solidify within the car. Short of solidifying, an alloy contained therein could undergo structural change that my adversely affect the metal.

One method of addressing this problem is to add additional heating furnaces along the processing line. The furnaces could then ensure that thermal loss is not so substantial as to affect the molten metal. However, such additional furnaces add to the processing time and cost.

A less costly alternative is to cover the opening of the transport car. Since the greatest thermal loss occurs through the opening in the top of the car, a cover over this area will preserve the heat within the metal and the transfer car when empty.

One problem associated with covers is the removal of the cover from the transport car when the car is carrying molten metal. Physical removal of the cover by workers exposes them to the dangers of the elevated temperatures associated with molten metal. To utilize powered equipment, such as a crane, is often impractical. Since many noxious and some toxic fumes are produced during the metal processing procedure, draft hoods are deployed along the processing line to draw these fumes safely away These hoods, however, limit the amount of over-head space available for the removal of the covers and, thus, negate the efficacy of a crane.

One device known for removal of covers from transfer cars with limited overhead space is taught in U.S. Pat. No. 5,002,635, which issued Jun. 11, 1991, to Scriven and entitled "REMOVABLE COVER FOR A HOT METAL TRANSFER CAR". Scriven teaches an apparatus formed integrally with a transfer car comprising a track extending from the platform of the transfer car to the opening on its top. A carriage, movably attached to the track, is transported by a power source, such as a motor connected to a drive chain, along the track. The carriage is joined to the cover, such that the cover is deployed over the opening or drawn away from it by the movement of the carriage.

While offering an improvement over the prior art, the Scriven device depends upon motorized Dower means for its operation. Failure of this power means will hamper the entire processing of the metal. Additionally, the cover could be caught while transported within the track, again preventing deployment or withdrawal thereof.

What is needed is an apparatus that can effect movement of the cover without reliance on a mechanical power source. Further, what is needed is an apparatus that can remove a cover from a transport car without the possibility of entrapping the cover and preventing movement thereof. It is to these goals that the present invention is directed.

SUMMARY OF THE INVENTION

The present invention concerns an apparatus for removing a cover from a hot metal transfer car, the apparatus being attached to the transfer car and comprising:

(a) a base member;

(b) a swing member having:

(1) a pair of arm members;

(2) a cross member integrally formed with the arm members, the cross member being substantially normal to the arm members, the cover being connected to the cross member:

(3) a pair of connection members having a first end and a second end, where the first end of the connection members are pivotally connected to the arms members and the second end of the connection members are pivotally connected to the base member; and (c) means for moving the swing member.

In a preferred embodiment, the means for moving the swing member comprises:

(a) a winch comprising a crank and a spool mounted to the base member;

(b) a cable extending from the spool of the winch and connected at a second end to one arm of the swing member:

(c) a bracket mounted upon the base member, the bracket having a stop mounted thereon, the wire of the winch being deployed over the stop of the bracket; and (d) means for controlling the movement of the swing member.

One embodiment of the means for controlling is envisioned as comprising a plurality of stops formed to the base member to prevent movement of the swing member.

The present invention will be better understood with reference to the following detailed description and accompanying drawings. Throughout the views depicted in the drawings, like references numerals refer to like parts of the present invention, in which:

DETAILED DESCRIPTION OF THE INVENTION

Figure 1:
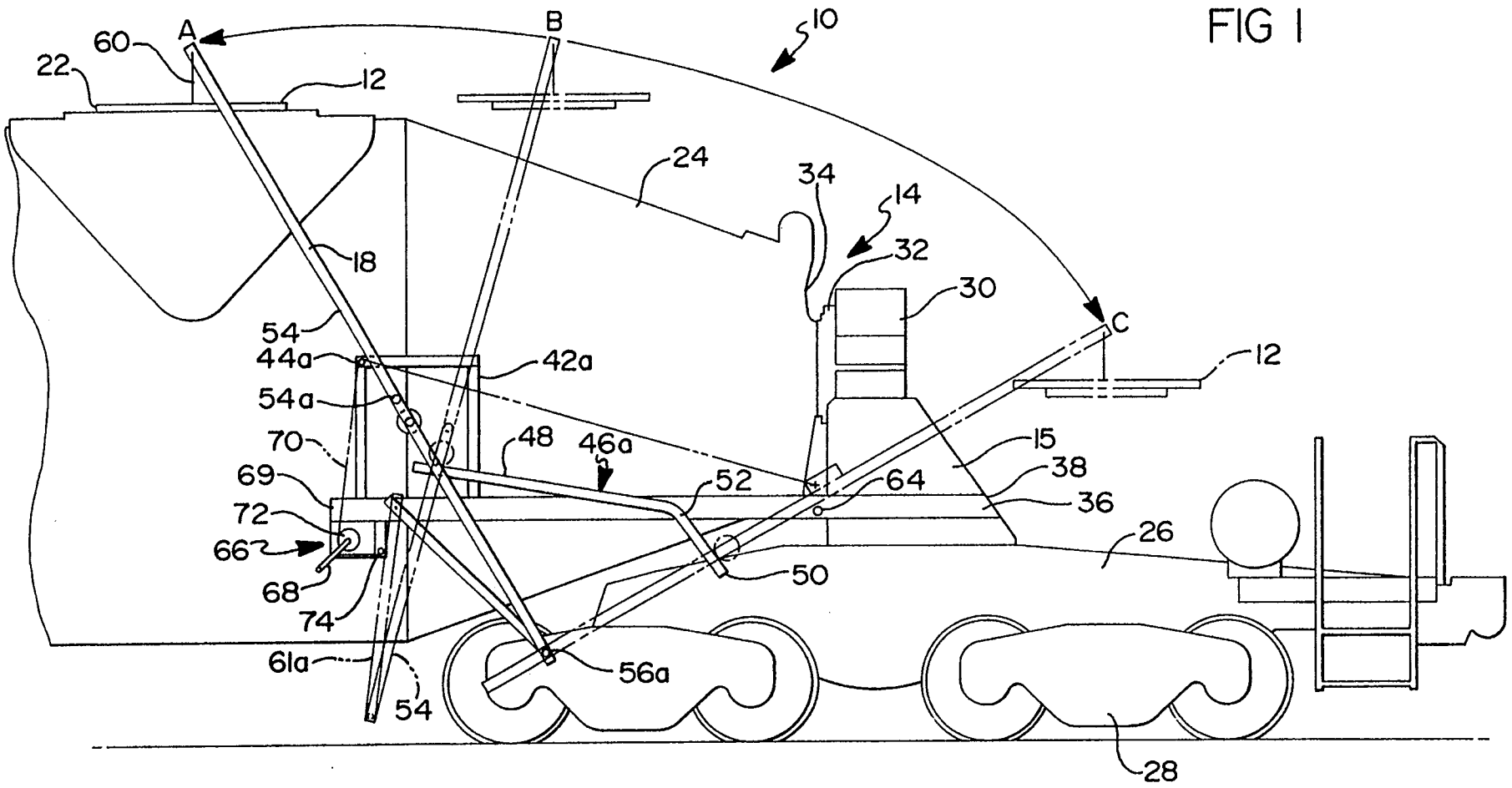
FIG. 1 is a side view of the cover removal apparatus of the present invention as integrated with a Pugh-type car.
Figure 2:
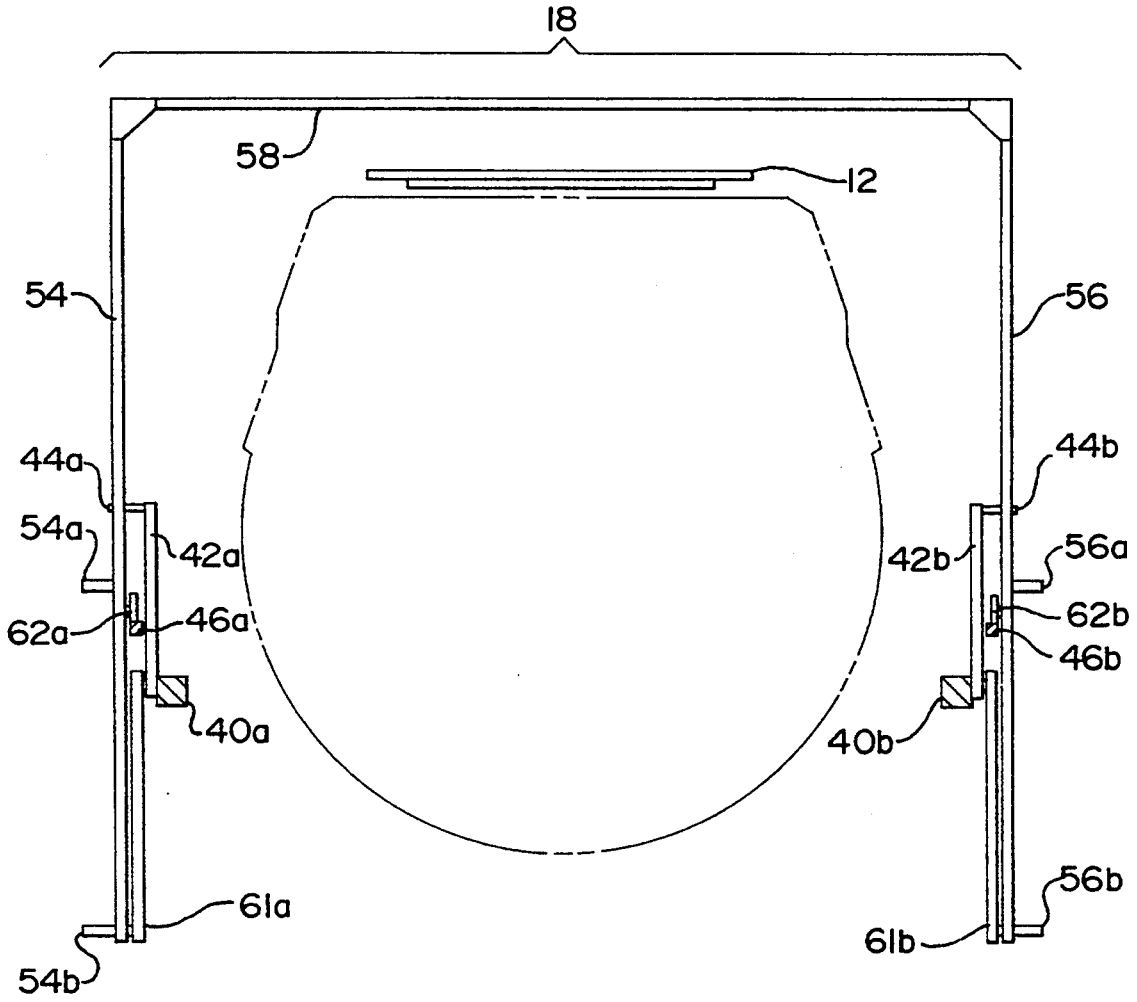
FIG. 2 is an end view of the cover removal apparatus of the present invention with the transfer car shown in shadow.

Referring now to FIGS. 1 and 2 there is shown the present invention, to wit, an apparatus 10 for removing a cover 12 from a transfer car 14 containing molten or liquid metal (not shown). The apparatus 10 comprises a base member 26, a swing member 18 and means 20 for moving the swing member.

The transfer car 14, as depicted in FIG. 1, is a Pugh-type transport car, which are well known in the metal processing industry. Alternately, different transport cars, such as Kling-type car, may be utilized in connection with the present invention. What is necessary for the car 14 is that there be an opening 22 formed therein atop the tanker portion 24 which is closed by a cover 12.

Typically, the car 14 further has a forward platform 26 having a wheel and axle assembly 28. The platform 26 could, alternately, have pivot wheeled trucks or other similar devices (not shown), as are known in the art. The transfer car 14 additionally comprises a rearward platform (not shown) which is substantially identical to the forward platform 26, with the exception that there is not a second apparatus of the present invention deployed thereon, as each car 14 only requires one apparatus 10 to remove the one cover 12 associated therewith. Thus, it will be understood that all descriptions concerning the forward platform 26 will equally apply to the rearward platform concerning its structure.

A housing 30 is mounted upon a support portion 15% the platform 26. The housing 30 contains bearings (not shown) and trunnion 32. which are connected to the forward point 34 of the tanker portion 24. The bearings and trunnion 32 cooperate to enable the tanker portion 24 of the car 14 to rotate when the liquid metal contained therein is to be poured out. However, before this procedure can occur, the cover 12 must be removed.

The apparatus 10 to remove the cover 12 comprises a clevis shaped base member 36. The base member 36 has a first end 38 connected to the support portion 15 of the platform 26 and two arms 40*a*, 40*b* which extend around each end of the tanker portion 24 as shown. The base member 36 serves as the main structural support for the apparatus 10.

A pair of opposed, identical brackets 42*a*, 42*b* are mounted on the base member 36, such that one bracket 42*a* is mounted upon one arm 40*a* and the second bracket 42*b* is mounted upon the second arm 40*b*. A first stop 44*a* and 44*b* is mounted upon each bracket 42*a*, 42*b*, the stops 44*a* and 44*b* serving to prevent movement of the cover 12 past the opening 22 when being placed thereover, as will be described in further detail herein below.

The present invention includes means 45 for guiding the movement of the swing member 18 while removing and seating the cover 12. The means 45 for guiding is attached to the base member 36. The means 45 for guiding comprises a pair of guide tracks 46*a* and 46*b* are mounted one on each side of the base member 36. Since both guide tracks are virtually, identical, only the guide track 46*a* will be described. As shown particularly in FIG. 1, identically the guide member 46*a* has a substantially planar first portion 48 and a substantially planar second portion 50. The second portion 50 is shorter in length than the first portion 48. The first portion 48 and the second portion 50 are joined by an arcuate portion 52. The guide member 46*a* is joined at the first portion 48 to the bracket 42*a*, and further joined to the base member 36 at the arcuate portion 52. The guide members 46*a* and 46*b* serve to control the movement of the swing member 18 in conjunction with the winch, as further described herein below.

The connection of the guide member 46*a* to the bracket 42*a* and base member 36 is such that the first portion 48, although a planar member, is descendingly inclined as the member 46*a* moves rearwardly. This allows gravity and the weight of the apparatus 10 and the cover 12 attached thereto to move rearwardly without need of a manual, mechanical, motorized or electrical force.

The apparatus 10 further comprises a swing member 18, as shown in FIG. 2. The swing member 18 has a pair of arms 54, 56 joined by a cross member 58. The cross member 58 is connected, by an intermediate member 60, to the cover 12. Movement of the swing member 18 thus will effect movement of the cover 12. The swing member 18 further comprises a pair of connection members or levers 61*a*, 61*b* having a forward end and a rearward end, one each being pivotally connected to one of the arms 54, 56 at the rearward end thereof. The levers 61*a*, 61*b* are additionally pivotally attached at the forward end thereof to the base member 36. By these two pivotal connections, the swing member 18 moves the cover 12 into and out of orientation over the opening 22.

The swing member 18 also comprises a pair of rollers 62*a*, 62*b*, one roller being mounted upon the inside surface of the arms 54, 56. The rollers 62*a*, 62*b* facilitate the movement of the swing member 18 along the guide members 46*a*, 46*b*, as described further herein below.

The swing member 18 further comprises a pair of manual assist bars 54*a*, 54*b*, 56*a*, 56*b* attached to each arm 54, 56. Hand assist bars 54a, 56a are attached to the arms 54, 56 proximate to rollers 62*a*, 62*b*. Foot assist bars 54*b*, 56*b* are attached to the arms 54, 56 proximate the connection of the arms 54, 56 and the levers 61*a*, 61*b*. The manual hand assist bars 54*a*, 56*a* and foot assist bars 54*b*, 56*b* assist in removing the cover 12 and positioning the swing member 18 on the guide members 46*a*, 46*b* as further described herein below.

A pair of second stops 64*a*, 64*b* are formed upon the base member 36. The stops 64 are located on the side surfaces of the base member 36, such that arms 54, 56 of the swing member 18 contact the stops 84 when the cover 12 is moved away from the opening 22 of the tanker portion 24 of the car 14. The stops 64*a*, 64*b* serve to define the furthest rearward deployment of the cover 12 and swing member 18.

To facilitate the drawing forward of the swing member 18, a winch 66 is connected to the swing member 18. A crank 68 is deployed along the bottom of the base member 36 proximate the rearward end 69 thereof. A length of wire 70 is wound around the crank 68 and extends therefrom and over the first stop 44 until connecting to the first arm 54. The crank 68 is turned, winding the wire 70 onto a spool 72 of the winch 66 and drawing the swing member 18 rearward. The rearward movement terminates when the arms 54, 58 of the swing member 18 reach the stops 64*a*, 64*b*.

In use, the apparatus 10 is deployed over the cover 12 when it blocks the opening 22 of the tanker portion 24. When the tanker portion 24 is to be opened, the arms 54, 56 are moved by force upon the hand assist bars 54*a* and 56*a* and foot assist bars 54*b*, 56*b* supplied by workers while the winch 70 is simultaneously loosened. This swings the arms 54, 56 rearwardly, as well as the cover 12 from A to B. The levers 61*a*, 61*b* swing until contact is made with the third stops 74. This prevents movement of the guide bars 61 and forces the arms 54, 56 to move downwardly. This motion brings the rollers 62*a*, 62*b* into engagement with the guide members 46*a*, 46*b*. As the arms 54, 56 extend outwardly, the levers 61 move away from engagement with the stops 74. The swing member 18 terminates movement when contact is made with the stops 64*a*, 64*b* at position C.

To bring the cover 12 back over the opening 22, the winch is cranked so that the wire 70 is wound around the spool 72 thereof. The arms 54, 56 are drawn forwardly as the rollers 62*a*, 62*b* follow the guide members 46*a*, 46*b*. The path is followed until the levers 61*a*, 61*b* first and then the arms 54, 56 meet the stops 44. The swing member 18 then rotates around the stop 44*a*, 44*b* until the arms 54, 56 contact the stops 44*a*, 44*b* which then position the cover 12 above and into opening 22.

The apparatus 10 of the present invention facilitates the quick removal of the cover 12 from the opening 22 or deployment of the cover 12 over the opening 22. This is achieved without the possibility of breakdown of a motorized source, nor the potential of blocking or catching the cover 12 in a housing. Additionally, the present invention may be deployed in areas with little overhead clearance, thus meeting the need of the art while offering benefits not heretofore realized.

Having, thus, described the present invention, what is claimed is:

1. An apparatus for removing a cover from a hot metal transfer car, the apparatus being attached to the transfer car and comprising:
(a) a base member;
(b) a swing member having:
(1) a pair of arm members;
(2) a cross member integrally formed with the arm members, the cross member being substantially normal to the arm members, the cover being connected to the cross member; and
(3) a pair of connection members having a rearward end and a forward end, where the forward end of the connection members are pivotally connected to the base member;
(c) means for moving the swing member; and
(d) means for guiding the movement of the swing member while removing and replacing the cover.

2. The apparatus of claim 1, wherein the means for moving comprises:
(a) a winch comprising a crank and a spool mounted to the base member;
(b) a cable wire extending at a first end to the spool of the winch and connected at a second end to one arm of the swing member; and
(c) a bracket mounted upon the base member, the bracket having a stop mounted thereon, the wire of the winch being deployed over the stop of the bracket.

3. The apparatus of claim 1, wherein the means for guiding the movement comprises:
(a) a pair of guide members mounted to the base member and the bracket;
(b) a pair of rollers, one roller attached to each arm of the swing member, each roller engaging a corresponding guide member so that the path of travel of the swing member is controlled; and
(c) a plurality of stops deployed upon the base member, the stops serving to limit the forward and rearward deployment of the swing member.

4. The apparatus of claim 2 further comprising: means for manually assisting the swing member to remove the cover from the transfer car.

5. The apparatus of claim 4 wherein the means for manually assisting the swing member comprises:
(a) a hand assist, the hand assist attached to each arm of the swing member proximate the rollers; and
(b) a foot assist, the foot assist attached to each arm of the swing member proximate the connection of the arm and the connection member.

6. An apparatus for removing a cover from a hot metal transfer car, the apparatus being attached to the transfer car and comprising:
(a) a base member;
(b) a swing member having:
(1) a pair of arm members;
(2) a cross member integrally formed with the arm members, the cross member being substantially normal to the arm members, the cover being connected to the cross member; and
(3) a pair of connection members having a rearward end and a forward end, where the forward end of the connection members are pivotally connected to the base member;
(c) means for moving the swing member; and
(d) a pair of guide members mounted to the base member for guiding the movement of the swing member.

7. The apparatus of claim 6, wherein the means for moving comprises:
(a) a winch comprising a crank and a spool mounted to the base member;
(b) a cable wire extending at a first end to the spool of the winch and connected at a second end to one arm of the swing member; and
(c) a bracket mounted upon the base member, the bracket having a stop mounted thereon, the wire of the winch being deployed over the stop of the bracket.

8. The apparatus of claim 1 further comprising:
(a) a pair of rollers, one roller attached to each arm of the swing member, each roller engaging a corresponding guide member so that the path of travel of the swing member is controlled; and
(b) a plurality of stops deployed upon the base member, the stops serving to limit the forward and rearward deployment of the swing member.

9. The apparatus of claim 7 further comprising:
means for manually assisting the swing member to remove the cover from the transfer car.

10. The apparatus of claim 9 wherein the means for manually assisting the swing member comprises:
(a) a hand assist, the hand assist attached to each arm of the swing member proximate the rollers; and
(b) a foot assist, the foot assist attached to each arm of the swing member proximate the connection of the arm and the connection member.

11. An apparatus for removing a cover from a hot metal transfer car, the apparatus being attached to the transfer car and comprising:
(a) a base member;
(b) a swing member having:
(1) a pair of arm members;
(2) a cross-member integrally formed with the arm members, the cross-member being substantially normal to the arm members, the cover being connected to the cross-member;
(3) a pair of connection members having a rearward end and a forward end, the forward end of the connection member being pivotally connected to the base member;
(c) means for moving the swing member, the means for moving comprising:
(1) a winch mounted to the base member and comprising a crank and a spool;
(2) a cable wire extending at a first end to the spool and connected at a second end to one arm of the swing member;
(3) a bracket mounted on the base member, a stop mounted on the bracket, the wire being deployed over the stop; and
(4) means for controlling the movement of the swing arm.

* * * * *